US010414627B2

(12) United States Patent
Wienholz-Buß et al.

(10) Patent No.: US 10,414,627 B2
(45) Date of Patent: Sep. 17, 2019

(54) ELEVATOR SYSTEM COMPRISING A DESTINATION CONTROL SYSTEM

(71) Applicant: KONE Corporation, Helsinki (FI)

(72) Inventors: Jörn Wienholz-Buß, Leer (DE); Seppo Numminen, Hyvinkää (FI); Janne Sorsa, Helsinki (FI)

(73) Assignee: KONE CORPORATION, Helsinki (FI)

( * ) Notice: Subject to any disclaimer, the term of this patent is extended or adjusted under 35 U.S.C. 154(b) by 603 days.

(21) Appl. No.: 15/171,827

(22) Filed: Jun. 2, 2016

(65) Prior Publication Data

US 2016/0272461 A1 Sep. 22, 2016

Related U.S. Application Data

(63) Continuation of application No. PCT/EP2014/050909, filed on Jan. 17, 2014.

(51) Int. Cl.
*B66B 1/34* (2006.01)
*B66B 1/46* (2006.01)
(Continued)

(52) U.S. Cl.
CPC ..... *B66B 1/468* (2013.01); *B63B 29/00* (2013.01); *B66B 1/2458* (2013.01); *B66B 3/006* (2013.01);
(Continued)

(58) Field of Classification Search
CPC ..... B66B 1/468; B66B 1/2458; B66B 3/006; B66B 2201/103; B66B 2201/301;
(Continued)

(56) References Cited

U.S. PATENT DOCUMENTS 5,300,739 A * 4/1994 Bittar ..... B66B 1/20 187/383
5,382,761 A * 1/1995 Amano ..... B66B 1/18 187/383
(Continued)

FOREIGN PATENT DOCUMENTS

WO WO 2007/036597 A2 4/2007

*Primary Examiner* — Anthony J Salata

(74) *Attorney, Agent, or Firm* — Birch, Stewart, Kolasch & Birch, LLP

(57) ABSTRACT

An elevator system includes at least one elevator group control with a destination control system, at least one elevator group having elevators with a different destination range, destination operating panels at each landing including an input for issuing destination calls, car operating panels located in the elevators having an input for the input of destination calls, hall lanterns for each elevator indicating the moving direction of the corresponding elevator, a signaling device for each elevator indicating the arrival of an elevator at the landing, the destination control system controls hall lanterns to indicate a moving direction of the elevators and activates the signaling device when elevators arrive at a landing. The destination control system displays, after the issue of a destination call, a range identifier indicative of the elevator's destination range, and the next arriving elevator by activation of its signaling device before its arrival at the landing.

20 Claims, 2 Drawing Sheets

(51) Int. Cl.
*B66B 1/24* (2006.01)
*B66B 3/00* (2006.01)
*B63B 29/00* (2006.01)

(52) U.S. Cl.
CPC ..... *B63B 2710/00* (2013.01); *B66B 2201/103* (2013.01); *B66B 2201/301* (2013.01); *B66B 2201/404* (2013.01); *B66B 2201/4623* (2013.01)

(58) Field of Classification Search
CPC ..... B66B 2201/404; B66B 2201/4623; B63B 29/00; B63B 2710/00
USPC ..... 187/247, 380–389, 391, 392, 393, 396
See application file for complete search history.

(56) References Cited

U.S. PATENT DOCUMENTS 5,831,226 A * 11/1998 Hattori ..... B66B 1/2458 187/382
6,394,231 B1 * 5/2002 Schuster ..... B66B 3/00 187/247
7,021,429 B2 * 4/2006 Hikita ..... B66B 1/462 187/391
7,036,635 B2 * 5/2006 Rintala ..... B66B 1/20 187/391
7,040,458 B2 * 5/2006 Forsythe ..... B66B 1/34 187/389
7,258,203 B2 * 8/2007 De Jong ..... B66B 1/2458 187/383
7,559,408 B2 * 7/2009 Flynn ..... B66B 3/00 187/391
7,841,452 B2 * 11/2010 Sansevero ..... B66B 1/46 187/382
8,136,636 B2 * 3/2012 Bahjat ..... B66B 1/463 187/391
8,584,813 B2 * 11/2013 Talonen ..... B66B 1/468 187/391
2001/0035314 A1 * 11/2001 Yoshida ..... B66B 1/463 187/382

* cited by examiner

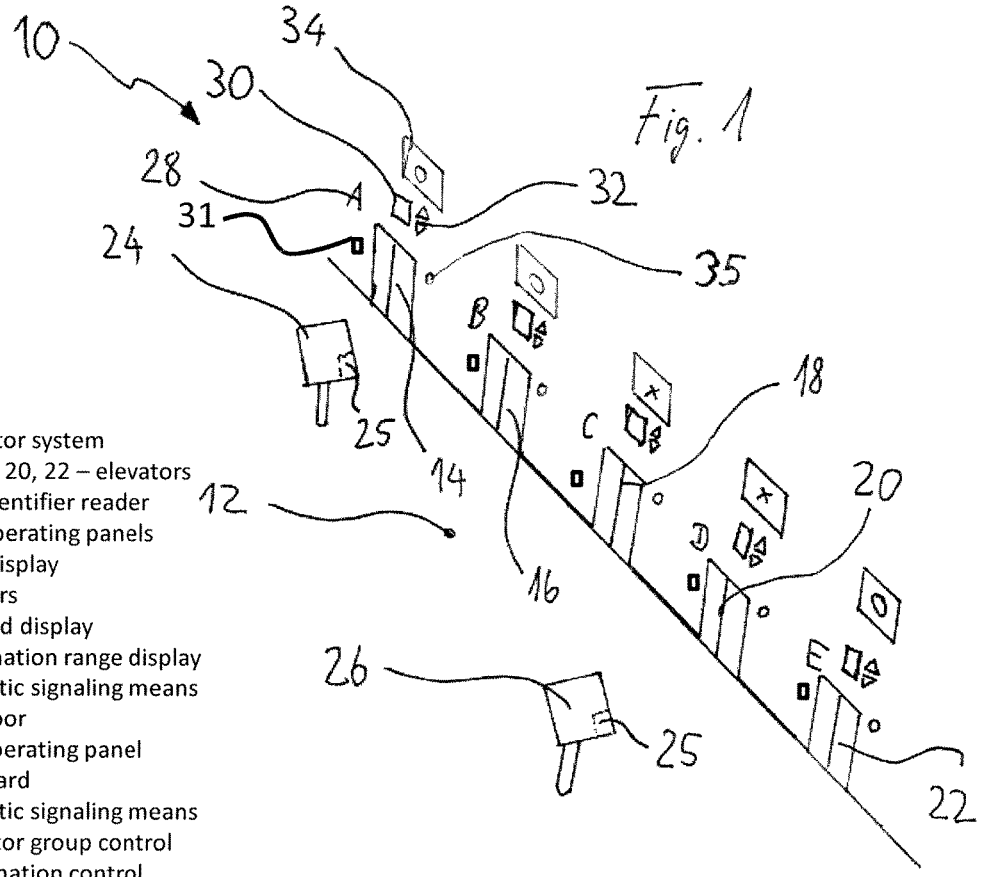
Fig. 1
Legend:
10 – elevator system
14, 16, 18, 20, 22 – elevators
25, 39 – identifier reader
24, 26 – operating panels
30 – first display
31 – sensors
32 – second display
34 – destination range display
35 – acoustic signaling means
36 – car door
38 – car operating panel
40 - keyboard
42 – acoustic signaling means
50 – elevator group control
52 – destination control system
54, 56 – serial bus
Fig. 2
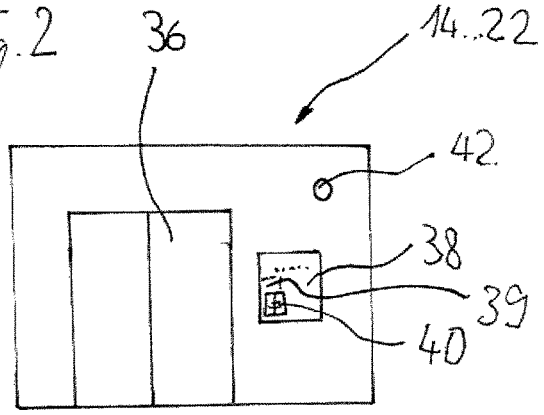

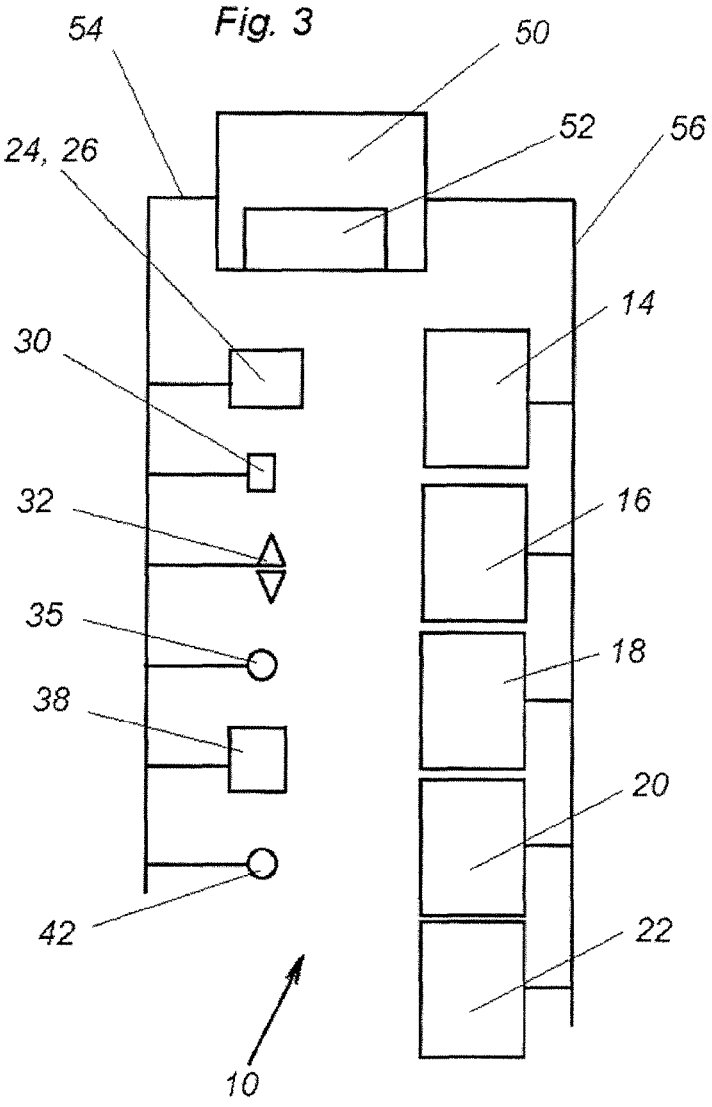
Legend:
10 – elevator system
14, 16, 18, 20, 22 - elevators
24, 26 – operating panels
30 – first display
32 – second display
35 – acoustic signaling means
38 – car operating panel
42 – acoustic signaling means
50 – elevator group control
52 – destination control system
54, 56 – serial bus

ELEVATOR SYSTEM COMPRISING A DESTINATION CONTROL SYSTEM

CROSS REFERENCE TO RELATED APPLICATIONS

This application is a Continuation of PCT International Application No. PCT/EP2014/050909, filed on Jan. 17, 2014, is hereby expressly incorporated by reference into the present application.

Still most common in elevator technology is a call allocation method called continuous call allocation whereby on each landing up/down buttons are provided and hall lantern means are arranged at each elevator to give information about the position and moving direction of the elevator. Nowadays systems use destination call control whereby the passenger inputs his destination floor on a destination operating panel whereafter the destination control system immediately allocates an optimal elevator according to a predefined cost junction, which is displayed on said destination operating panel. Sometimes the destination operating panels have separated devices for the input and display of data but the input and output devices can also be located, combined on a touch screen display which is then used for input of data as well as for displaying data to the passenger.

The invention concerns particularly customized destination control systems (DCS) for cruise ships, where elevators in one group may serve different decks (floors) or users need to be guided to one of two elevator groups residing close to each other. In some boarding situations the traffic between two elevator groups (e.g. portside and starboard side) needs to be balanced because of the huge demand of transport capacity.

Particularly in elevator systems used by passengers which are not familiar with the use of destination control stems, e.g. on cruise ships, problems arise as the passengers who are not familiar with the handling of destination operating panels block the few destination operating panels whereby the efficiency of the destination control system drops essentially, particularly in times of heavy traffic. A further problem is that particularly on cruise ships with lots of different decks, the different decks are served by different elevators which furthermore complicate the allocation of the elevators. A particular problem arises in the boarding stage when a lot of passengers try to reach their destinations served only by certain elevators of the group(s).

Accordingly, it is object of the present invention to provide an elevator system using destination control providing a high transport capacity and a high efficiency and service comfort also for inexperienced users.

The object is solved with an elevator system according to claim 1. Preferred embodiments of the invention are subject-matter of the dependent claims.

In the following description the terms deck, landing and floor are used as synonyms meaning one level serviced by the elevator system. DCS is an abbreviation for destination control system. DOP is an abbreviation for destination operating panel. COP is an abbreviation for car operating panel.

According to the invention, the elevator system does not only comprise the features related to destination call control i.e. destination operating panels as the landings, but the elevator system also comprises car operating panels in the elevators which allow the issue of car calls within the elevators, hall lantern means for each elevator indicating the position as welt as the moving direction of the corresponding elevator as well as signaling means which could be combined with the hall lantern means for each elevator indicating the arrival of an elevator at the landing floor. The car operating panel, the hall lantern means as well as the signaling means are typical features of a continuous call allocation system. Accordingly, the elevator system combines the advantage of the improved efficiency of a destination control system with the advantageous handling of a continuous call operating system which may be used by inexperienced users which are not common with the handling of destination control systems. Furthermore, each elevator has therefore a range identifier which indicates a certain destination range serviced by the elevator, which facilitates the finding of the correct elevator for a certain destination. Thereby one range identifier, e.g. a color, is identical to all elevators having the same destination range (the same serviced landings).

The destination control system of the inventive elevator system is configured to allocate the elevators of the elevator group according to the continuous call allocation principles although being a destination control system. This means that after having got a destination call via the DOP, the destination control system displays via the DOP the elevators (of one or several elevator groups) servicing the destination by indicating or displaying a corresponding range identifier, which is indicative of the destination range serviced by the corresponding elevator. Further, the destination control system controls the hall lantern means to indicate the position and the moving direction of all the elevators and the destination control system is further configured to activate the signaling means when any elevator of the at least one elevator group arrives at a landing. The DOP may optionally also be configured to indicate an allocated elevator in immediate call allocation. This allocation modes could e.g. used when there is not much traffic in the elevator system.

After having been informed via the DOP of the range identifier the passenger may look for the next adapted elevator serving his destination (via the range identifier) and the hall lantern means indicate to him which of adapted elevators will arrive next, which is then indicated by the signaling means. This facilitates the use of the elevator system comprising elevators with different destination ranges also by inexperienced passengers. The range identifier could be realized for example directly indicating the serviced destination range on a display above each elevator. The range identifier could also be a simple sign or color that is identical to all elevators with identical destination range.

The signaling means for each elevator indicating the arrival of an elevator at the landing floor may be an acoustic or a visual signaling means. The signaling means can also be a combined signaling means which gives an acoustical as well us a visual signal ration of the arrival of the elevator at the landing. On this behalf the signaling means may be combined with the hall lantern means. Via this clear signalization, the passengers waiting in the lobby clearly acknowledge the arrival of the elevator, the moving direction of the elevator and also the destination range of the corresponding elevator via the range identifier. Accordingly, even if they have not issued a destination call as a destination operating panel of the elevator system, they are able to enter the correct elevator and to issue their destination call via the car operating panel located in the elevator. Via this measure, the inventive elevator system provides a kind of hybrid system of a destination control system with continuous call allocation which is known from the old up/down push button elevator systems and improves the transport capacity of the elevator system essentially.

Thus, the inventive elevator system having a hybrid allocation system (continuous destination control) provides best efficiency as it provides more information to the elevator control than the old continuous call systems where the destination floor has not been issued and had to be estimated according to statistical data. On the other hand the inventive elevator system provides a better passenger comfort to passengers which are not familiar with destination control systems or in situations where the lobby is too crowded for a proper use of immediate call allocation of a DCS. Accordingly, the inventive elevator system provide s sophisticated transport efficiency also in crowded situations or peak traffic situations where the lobby is crowded which leads normally to decrease of efficiency of conventional destination control systems. The invention is preferably configured for ships, e.g. cruise vessels with a lot of decks which are served by different elevators of the elevator system. On these cruise ships, various unexperienced persons as children, old persons, handicapped persons have to be transported whereby in peak traffic situations, for example at boarding, lunch or dinner time, heavy traffic situations occur which make the handling of a pure destination control system difficult.

The invention simplifies the use of DCS considering the many kinds of users (adults, children, elderly people, disabled) traveling in groups of varying size (singles, couples, families, groups of friends), which users may not be familial with DCS or even elevators in groups. Accordingly, the invention raises the efficiency of a DCS improving the capacity and the end user/customer comfort of the elevator system.

A farther advantage of the invention is the simplicity in use for less-experienced elevator users and efficient use of elevators due to continuous call allocation. In addition, the invention simplifies landing call station arrangements so that extra call buttons (FEB/FET) are not needed if elevators in the group have different bottom-top decks.

The invention provides following advantages:

1) Guidance of users to correct elevators serving their destination deck in the case that the elevators serve different decks.
2) Guidance of users to the correct elevator group if the groups serve different decks.
3) Guidance of users to a specific elevator group to balance the traffic between two (or more) groups.
4) Efficient use of DCS (and elevators) in cruise ships taking into account the wide variety of users.

By showing the range identifier in DOP that is common to the elevators that can serve the destination, which range identifier can be for example, certain colors, literals or pictures, the inexperienced passenger can immediately recognize the correct elevators for his destination. Normal hall lantern means with up/down lanterns and signaling means with acoustic signaling as e.g. gongs and/or visual signaling means, e.g. the up/down lanterns, signal an arriving elevator. The destination car call is automatically sent to the elevator and the signaling means is lit when it arrives. The DOP may show the correct elevator group, possibly with lobby map, if several elevator groups are provided. In case several elevator groups are provided in the elevator system one multi group control can be provided or several group controls arrange via bi-directional communication the interaction as to allocate the optimal elevator of one of the groups. On this behalf the DCS provides in connection with the group control a serving cost estimate, e.g. expected waiting, time, which then decides the serving elevator group or elevators of one group and informs the user/passenger.

Wish respect to the guidance of users to a specific elevator group to balance the traffic between two (or more) groups, it is possible so send destination calls to elevator group controls either front DOPs, preferably portable ones for easy and fast mounting in the gangway, or from the ship's access control system as all users must swipe then individual identifiers, usually ID-cards, when entering the gangway. The access control system could send the domination floor of the user where his/her cabin is located or only landing call. The latter option is preferred because of the long walking distance from the gangway to the elevator lobbies (easily 30-60 seconds, with slowly walking tourists) and because they may want to travel directly to the restaurant/pool instead of their cabins. The guidance can be implemented as separate displays on the ceiling or manually by personnel who are given instructions on where to guide passengers. Anyway, the functionality is more like crowd detection, and also guidance is targeted to a crowd, e.g. "next elevator will arrive in the port side lobby" not towards individuals. Also crowd detection sensors could be applied here instead of destination calls.

The DCS can use continuous DCS call allocation, whereby the user is informed only about the elevators which serve his destinations but the next elevator to serve his destination is announced via the signaling means before its arrival at the landing. Also immediate allocation can be used in principle but the users and user groups decrease its efficiency too much.

In a preferred embodiment of the invention, the elevators with identical destination ranges are marked with the same range identifier and an allocated elevator is indicated on the destination operating panel via its range identifier. By this measure the passenger knows which elevators are to serve his destination. Thereafter he can wait for the next of these elevators to arrive in the direction of his destination which is indicated by the hall lantern means and the signaling means. Therefore the advantage of destination call control and continuous call control is combined in a very efficient way, so that the passenger has only to concentrate on the correct elevators serving his deck/landing.

The provision of range identifiers facilitate the search for the correct elevators to serve their decks or landings as such a range identifier can be made very easy to notify, for example a literal, a number or even better, a color, if a color is used as range identifier, this color cars be easily remembered by the passengers as to easily find their elevators that serve their destination floor or deck.

The range identifier is provided in the vicinity of the elevator, e.g. at its top or side or surrounding its landing door, if the range identifier is shown on a display the grouping of elevators to serve different destination ranges is selectable/changeable. The range identifier may also be a literal or color which is painted to the wall where the landing door is provided. This kind of range identifier can easily be remembered fey the passengers.

The elevator system may comprise one or several elevator groups, whereby the elevators of one group or the elevators of the different groups serve different destinations. In case several groups are provided one multi-group control can be provided in which the DCS for the different elevator group is coordinated. Alternatively, several elevator group controls may be provided which interact to guide the passengers between the groups.

In a preferred embodiment of the invention, the range identifier it indicated on a display which can be controlled by the elevator control or the destination control system.

Via this range identifier being displayed on a display above the elevators, it is possible to use any desirable type of range identifier so that the range identifier can be adapted to different user groups of the elevator system. This particularly holds true if the ship is used in different regions of the world so that the range identifier can be adapted 10 different languages.

Preferably, the destination operating panel as well as the car operating panel comprise an ADA-keyboard. i.e. a decade keyboard which can easily be handled also by disabled persons. This facilitates the use of the elevator system also by young children and by handicapped people.

Preferred, the destination operating panel as well as car operating panel comprise an identifier reader which initiates the destination control system to automatically read the destination of passenger having presented on ID-tag. The identifier reader may be a card reader or an RFID reader or any other corresponding identification tag reader.

The inventive elevator system can be easily added up by special calling modes as for example emergency call mode. VIP call mode by the use of individual identifiers which switch the destination control system automatically in the corresponding service mode whereby the corresponding passenger is handled with a certain preset priority.

Of course, the inventive hybrid elevator system is not only applicable on large cruise ships but also on other places where different kind of people an well as people with low experience are using the elevator system, e.g. in malls, railway stations and airports.

It shall be remarked that the inventive elevator system works without up/down push buttons.

The DCS may switch from continuous call allocation to immediate call allegation, e.g. in quiet times, e.g. when a couple of elevators are put out of service (at night-time). In this immediate allocation the passenger is immediately informed on the DOP of his allocated elevator after having issued his destination call at the DOP.

The invention is hereinafter described schematically with the help of the enclosed drawings.

IN THESE FIGURES

FIG. 1 shows a perspective view of an elevator lobby comprising elevator with two different destination ranges FIG. 2 shows the view from inside of an elevator to the elevator car door and a car operating panel and FIG. 3 a schematic diagram of an elevator control having a destination control system controlling functions of a continuous call allocation system.

FIG. 1 shows a perspective view of a lobby landing 12 of a landing of an elevator system 10, from which lobby there is access to at least five elevators 14, 16, 18, 20, 22. In the lobby 12, there are two destination operating panels 24, 26 which comprise an input means for issuing destination calls, e.g. an ADA-keyboard as well as a display and or a touch screen for indicating adapted elevators serving the issued destination to the passenger, preferably immediately, after having issued the destination call. Each of the five elevators 14-22 has an individual identifier 28, in this embodiment the literals A-E. Each elevator has on its top a hall lantern means comprising a first display 34 for the actual position of the elevator as well as a second display 32 for indicating the moving direction of the elevator.

Furthermore, each elevator has a range identifier display 34 which range identifier indicates a certain destination range serviced by the elevator. The range identifier may for example be a literal, a number or a color or as in the displayed embodiment a figure as a circle and a cross. Each range identifier stands for a certain destination range of the corresponding elevator whereby on the DOP as well as eventually at any place in the elevator lobby there may be an information showing the correlation of range identifier and serviced destinations. In the presented embodiment where the range identifier is displayed on a range identifier display 34, it is even possible to indicate the destination range of the corresponding elevator directly, e.g. "decks 10 to 24".

All the equipment indicated in FIG. 1 is connected to the elevator control or elevator group control which comprises a destination control system as shown in FIG. 3. Accordingly, the inventive elevator system performs continuous destination control based on the destination operating panels 24 and 26 without up down push buttons whereby the destination calls are issued and the possible elevators to serve the call are displayed with their range identifier. The destination control system also controls the first and second display 30, 32 of the hall lantern means as well as the destination range display 34 as well as an acoustic signaling means 35 indicating the arrival of an elevator at the landing.

FIG. 2 shows the view from the interior of an elevator 14-22 to the car door 36. Aside of the car door 36 a car operating panel (COP) 38 is located in the car wall, via which COP destinations can be input, e.g. via a decade keyboard 40 provided on a touch screen of said COP 38 or via a separate keyboard. If the car operating panel 38 is a touch screen, the ADA-keyboard 40 can be displayed on the panel. The car operating panel 38 can also indicate the next destinations of the elevator car in moving direction, furthermore, an acoustic signaling means 42, usually a loudspeaker or gong, is provided in the elevator car to inform particularly visually handicapped people about the destinations of the car and the next stop of the elevator car.

FIG. 3 shows the elevator group control 50 comprising a destination control system 52 in which the immediate call allocation which is usually with destination call systems is performed. The destination control system 52 may be integrated into the elevator group control or may be a separate part, e.g. a plug-in module of the elevator control. The destination control system 52 communicates with the different devices via two serial buses 54, 56 to which the different components of the elevator system are connected. To the first serial bus 54 which is connected to the elevator group control 50, the destination operating panels 24, 26, the first display 30, the second display 32 of the hall lantern means as well as the acoustic signaling 35 is connected. In this connection, also the second display 32 which indicates the moving direction of the elevator may be used as a signaling means so that when the elevator arrives at a landing, one or both arrows of the second display 32 flash up for a certain moment maybe together with an acoustic signaling of the acoustic signaling means 35.

The first serial bus 54 in further connected to the car operating panel 38 as well as to the loudspeaker 42 located in the elevator.

Via a second bus 56, preferably a serial bus, the elevator group control 50 communicates with the elevators 14, 16, 18, 20, 22 of the elevator group. The communication between the elevator group control 50 and the elevators 14-22 may happen in a way that the different components of the elevator as motor, brakes, door drives, etc. are directory controlled via the elevator group control 50 or in a way that each elevator 14-22 has its own elevator control which communicates with the different components of the elevator. In this case the communication between the elevator group control 50 and the elevator control of the different elevators

14-22 only comprises the control orders and status messages offer the different elevators and handshaking.

The destination control system of the inventive elevator system always tries to allocate the best elevator according to evaluation principles of a cost function which evaluation principles comprise (or example passenger riding time, passenger wailing lime, total riding time, energy consumption, transport capacity, etc.

Of course, the elevator system may comprise several sensors 31 as e.g. load sensors in the elevator cars, people sensors in the lobbies 12 to get information about the loading of the elevator cars and about the traffic in the elevator system. These data can be used together with the data issued via the destination operating panels 24, 26 as well as the car operating panels 38 to improve the handling capacity of the elevator system as well as the service quality thereof.

The invention may be varied within the scope of the appended patent claim. The above-mentioned embodiments be combined with each other as long as this is technically feasible.

The invention claimed is:

1. An elevator system comprising:

at least one elevator group control with a destination control system (DCS);

at least one elevator group having elevators with a different destination range;

destination operating panels (DOP) at each landing comprising an input configured to issue destination calls;

car operating panels (COP) located in the elevators having an input configured to input destination calls;

a hall lantern for each elevator indicating the moving direction of the corresponding elevator;

a signaling device for each elevator indicating the arrival of an elevator at the landing;

a first serial bus connected to the destination operating panels, the hall lantern and the signaling device; and a second serial bus, separate from the first serial bus, wherein the second serial bus is connected to each elevator group control and the elevators, wherein the DCS controls the hall lantern to indicate the moving direction of the elevators and wherein the DCS is further configured to activate the signaling device when elevators of the group(s) arrive at a landing, wherein the DCS is configured to display, after the issue of a destination call at the DOP, a range identifier of the elevators serving the destination, which range identifier is indicative of the elevator's destination range, and to indicate the next arriving elevator by activation of the signaling device of the arriving elevator before arrival of the arriving elevator at the landing, and wherein the range identifier of each of the elevators of the elevator system is located in a vicinity of each elevator.

2. The elevator system according to claim 1, wherein the elevator system is configured to be installed on a ship, and the landings are decks of the ship.

3. The elevator system according to claim 1, wherein the elevators serving the destination are displayed on the DOP together with their range identifier.

4. The elevator system according to claim 3, wherein the elevators serving the destination are displayed by the DOP.

5. The elevator system according to claim 3, wherein an allocated elevator is displayed on the DOP via its individual number as well as with its range identifier.

6. The elevator system according to claim 1, wherein the range identifier is a color.

7. The elevator system according to claim 1, wherein each DOP and/or COP comprises an ADA-keyboard.

8. The elevator system according to claim 1, wherein each DOP and/or COP comprises an identifier reader.

9. The elevator system according to claim 8, wherein upon reading an individual identifier via the identifier reader the destination control system is configured to load pre-stored destination data from the identifier.

10. The elevator system according to claim 1, wherein the hall lantern and the signaling device comprise a common second display for the moving direction.

11. The elevator system according to claim 1, wherein the signaling device comprises an acoustic signaling device.

12. The elevator system according to claim 1, wherein the destination control system uses sensor data from the elevator group control for an optimal call allocation.

13. The elevator system according to claim 12, wherein the elevator group control is connected to load sensors of the elevators.

14. The elevator system according to claim 12, wherein the elevator group control is connected to passenger sensors at the landings and/or in the elevators.

15. The elevator system according to claim 1, wherein the destination control system uses for the call allocation a cost function wherein different service parameters are considered.

16. The elevator system according to claim 1, wherein the DCS is configured to switch an immediate call allocation principle wherein an elevator is immediately allocated after a destination call has been input via the DOP, and wherein the allocated elevator is displayed on the corresponding DOP where the destination call has been issued.

17. The elevator system according to claim 1, wherein the hall lantern for each elevator is configured to indicate the position of the corresponding elevator, and wherein the DCS further controls the hall lantern to indicate the position the elevators.

18. The elevator system according to claim 12, wherein the sensor data is load data or traffic data.

19. The elevator system according to claim 15, wherein the different service parameters are passenger waiting time, passenger driving time or energy consumption.

20. The elevator system according to claim 2, wherein the elevators serving the destination are displayed on the DOP together with their range identifier.

* * * * *